US008009999B2

(12) United States Patent
Takane

(10) Patent No.: US 8,009,999 B2
(45) Date of Patent: Aug. 30, 2011

(54) IMAGE FORMING APPARATUS AND IMAGE FORMING METHOD

(75) Inventor: Toshiaki Takane, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 402 days.

(21) Appl. No.: 12/389,428

(22) Filed: Feb. 20, 2009

(65) Prior Publication Data

US 2009/0214236 A1 Aug. 27, 2009

(30) Foreign Application Priority Data

Feb. 27, 2008 (JP) ..... 2008-046747

(51) Int. Cl.
*G03G 15/01* (2006.01)
*G03G 15/00* (2006.01)

(52) U.S. Cl. ..... 399/39; 399/72; 399/301

(58) Field of Classification Search ..... 399/39–41, 399/72, 302
See application file for complete search history.

(56) References Cited

U.S. PATENT DOCUMENTS

| | | | | |
|---|---|---|---|---|
| 6,198,490 | B1 * | 3/2001 | Eom et al. | 347/116 |
| 6,278,857 | B1 * | 8/2001 | Monji et al. | 399/301 |
| 7,366,444 | B2 | 4/2008 | Takane | |

FOREIGN PATENT DOCUMENTS

| | | |
|---|---|---|
| JP | 2005-202110 | 7/2005 |
| JP | 2005-289035 | 10/2005 |
| JP | 2006-171352 | 6/2006 |
| JP | 2007-121907 | 5/2007 |
| JP | 2007-292936 | 11/2007 |

* cited by examiner

*Primary Examiner* — David Gray
*Assistant Examiner* — Joseph Wong
(74) *Attorney, Agent, or Firm* — IPUSA, PLLC

(57) ABSTRACT

A tandem-type image forming apparatus includes a toner mark pattern forming unit configured to form a toner mark pattern; a sensor configured to detect the toner mark pattern; a first determining unit configured to determine presence or absence of color misregistration based on the detected result; and a color misregistration correcting unit configured to correct the color misregistration based on the determined result. The toner mark pattern includes paired toner marks disposed at different coordinates in the sub-scanning direction. One of the paired toner marks has their ends at different coordinates in the main scanning direction with respect to those of the other one. The first determining unit determines the presence or absence of the color misregistration in the main scanning direction based on the result of the detection of the paired toner marks.

16 Claims, 17 Drawing Sheets

FIG.9

| | COLOR MISREGISTRATION DETERMINING CONDITIONS |
|---|---|
| 1 | $\alpha$ FAILED TO BE DETECTED or $\beta$ FAILED TO BE DETECTED |
| 2 | $\alpha$ WAS SUCCESSFULLY DETECTED and ONLY 50% OR LESS OF $\beta$ WAS DETECTED |
| 3 | $\beta$ WAS SUCCESSFULLY DETECTED and ONLY 50% OR LESS OF $\alpha$ WAS DETECTED |

IMAGE FORMING APPARATUS AND IMAGE FORMING METHOD

BACKGROUND OF THE INVENTION

1. Field of the Invention

The present invention relates to an image forming apparatus and an image forming method.

2. Description of the Related Art

Tandem-type image forming apparatuses having a transfer belt have become mainstream image forming apparatuses in recent years. In a tandem-type color image forming apparatus, image forming units provided for respective toner colors of cyan, magenta, yellow and black and each including an exposing device, a photoreceptor, a developer and the like are tandemly arranged in the transporting direction of a recording sheet (a medium on which an image is to be transferred).

In each image forming unit for a particular color, the exposing device forms a latent image on the photoreceptor, and the developer develops the latent image, thereby forming a toner image of the corresponding color. Subsequently, toner images of the colors are sequentially transferred and superposed one upon another onto a recording sheet conveyed by the transfer belt. In this manner, a full color toner image is formed.

Tandem-type image forming apparatuses may, however, cause color misregistration which is displacement of a transfer position of a toner image of each color due to displacement of an optical scanning position of each exposing device or the like, which results in a reduction in image quality. Accordingly, for tandem-type image forming apparatuses, it is necessary to detect the presence of color misregistration and correct the color misregistration.

In an image forming apparatus, detection and correction of color misregistration is performed using a toner mark pattern for a color misregistration measurement. The toner mark pattern is formed on a moving object, such as a recording sheet conveying belt, and read by a toner mark sensor (hereinafter, referred to as "TM sensor"). Based on the toner mark pattern read by the TM sensor, the amount of color misregistration is detected for each color, and an operation for correcting the color misregistration is performed according to the detected amount of the color misregistration.

The following has been proposed as technologies related to color misregistration correction using the above-mentioned toner mark pattern.

Patent Document 1 discloses a technology applied to an image forming apparatus for providing different types of writing error correction means in the space between two recording sheets. According to the disclosed technology, writing error correction can be performed without causing downtime.

Patent Document 2 discloses a technology applied to an image forming apparatus for correcting color misregistration by forming a toner mark pattern of an arbitrary number of toner colors, which is smaller than the maximum number of toner colors, in accordance with the space between two recording sheets.

[Patent Document 1] Japanese Laid-open Patent Application Publication No. 2005-289035

[Patent Document 2] Japanese Laid-open Patent Application Publication No. 2007-292936

The above conventional technologies correct color misregistration both in the main scanning direction and in the sub-scanning direction without changing the width of the space between the recording sheets and use a common toner mark pattern for the color misregistration correction. Accordingly, even in order to detect color misregistration only in the main scanning direction, it is necessary to calculate a distance between toner marks detected by a sensor. Note here that the term "toner mark" used in the description of the present application refers to a single mark (for example, an individual line) On the other hand, the term "toner mark pattern" refers to a collective set of one or more toner marks formed in one given space (e.g. a space between two recording sheets).

SUMMARY OF THE INVENTION

In view of the above problem, the present invention aims at providing an image forming apparatus capable of readily determining the presence of color misregistration in the main scanning direction with the use of a novel toner mark pattern.

One embodiment of the present invention may be a tandem-type image forming apparatus including a toner mark pattern forming unit configured to form a toner mark pattern on a transfer belt; a sensor configured to detect the toner mark pattern; a first determining unit configured to determine presence or absence of color misregistration based on a result of the detection obtained by the sensor; and a color misregistration correcting unit configured to correct the color misregistration based on a result of the determination obtained by the first determining unit. The toner mark pattern formed by the toner mark pattern forming unit includes a pair of toner marks which are disposed at different coordinates in a sub-scanning direction. One of the paired toner marks has their ends at different coordinates in the main scanning direction with respect to the ends of the other one. The first determining unit determines the presence or absence of the color misregistration in the main scanning direction based on the result of the detection of the paired toner marks obtained by the sensor.

Another embodiment of the present invention may be an image forming method applied to a tandem-style image forming apparatus, the image forming method including a toner mark pattern forming step of forming a toner mark pattern on a transfer belt; a detecting step of detecting the toner mark pattern by a sensor; a first determining step of determining presence or absence of color misregistration based on a result of the detection obtained by the sensor; and a color misregistration correcting step of correcting the color misregistration based on a result of the determination obtained in the first determining step. The toner mark pattern formed in the toner mark pattern forming step includes a pair of toner marks which are parallel to a main scanning direction and are disposed at different coordinates in a sub-scanning direction. The first determining step determines the presence or absence of the color misregistration in the main scanning direction based on the result of the detection of the paired toner marks obtained by the sensor.

BRIEF DESCRIPTION OF THE DRAWINGS

FIG. 9 shows conditions used to determine the presence or absence of color misregistration according to the embodiment;

DETAILED DESCRIPTION OF THE PREFERRED EMBODIMENTS

An embodiment that describes the best mode for carrying out the present invention is explained next with reference to the drawings.

(a) Embodiment

Figure 1:
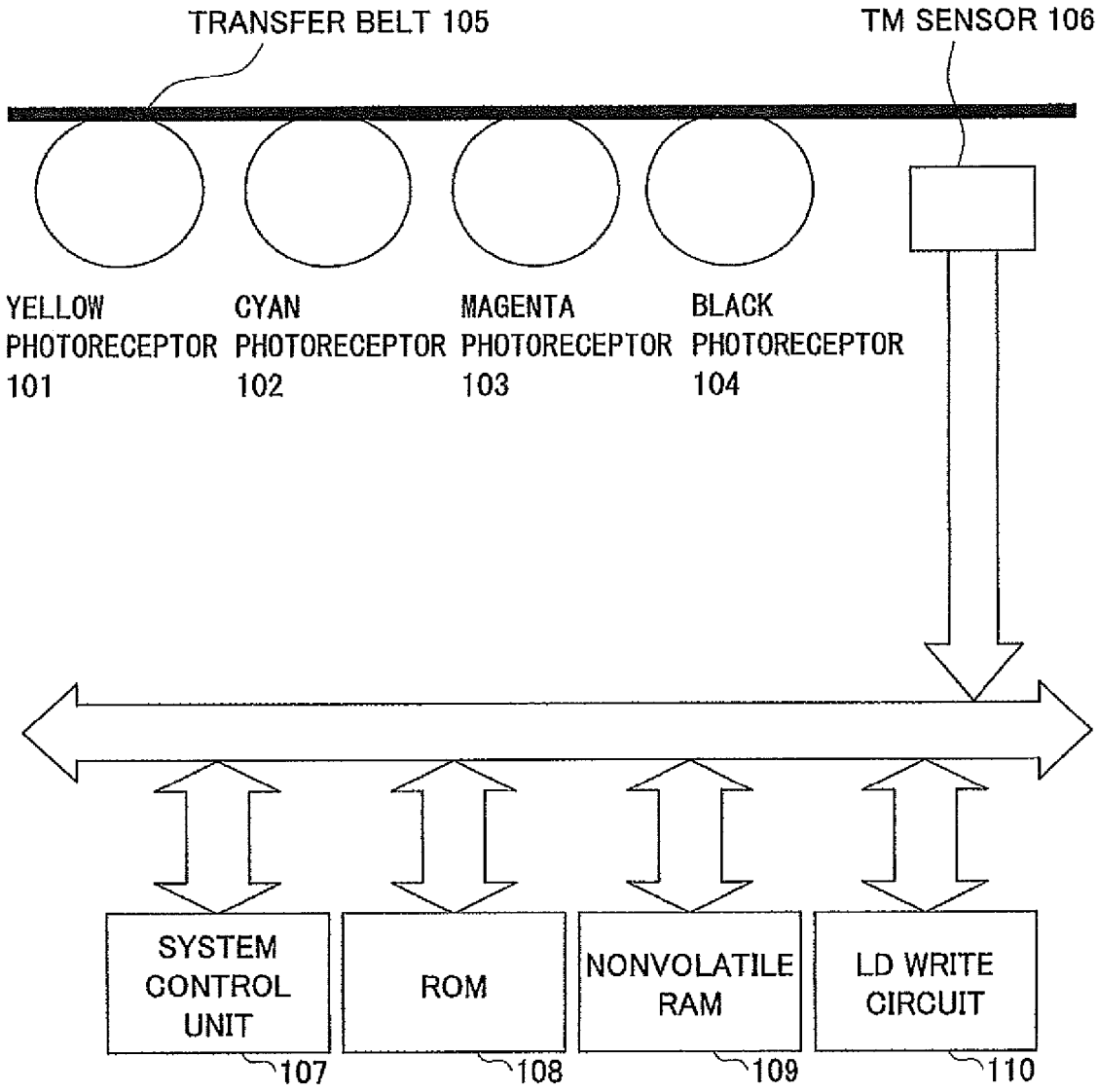
FIG. 1 is a block diagram showing a schematic hardware configuration of an image forming apparatus of an embodiment of the present invention.

An image forming apparatus according to an embodiment of the present invention serves various image forming functions and has a functional configuration, for example, as shown in FIG. 1. FIG. 1 is a block diagram showing a schematic hardware configuration of the image forming apparatus of the present embodiment.

The image forming apparatus of FIG. 1 includes photoreceptors 101-104, a transfer belt 105, a TM sensor 106, a system control unit 107, a ROM 108, a nonvolatile RAM 109, and an LD write circuit 110.

The photoreceptors 101-104 are provided parallel to one another along the transfer belt 105. Each of the photoreceptors 101-104 has a surface on which a toner image is formed. The toner image on the surface of each photoreceptor 101-104 is transferred to the transfer belt 105. Details of the photoreceptors 101-104 and the transfer belt 105 are described later.

The TM sensor 106 detects and reads a toner mark pattern formed on the transfer belt 105. Specifically, the TM sensor 106 causes a photoelectric conversion element, such as a phototransistor, to receive reflected or transmitted light from the transfer belt 105 and convert the received light into a voltage indicating the amount of the received light. The TM sensor 106 detects the toner mark pattern based on the converted voltage.

The system control unit 107 processes the toner mark pattern detected by the TM sensor 106 and performs control relating to correction of color misregistration in the main scanning direction. The ROM 108 stores a program for controlling image formation, a program for controlling color misregistration correction and the like. The nonvolatile RAM 109 stores data for color misregistration correction, a predetermined value for determining that one toner mark pattern is formed for every predetermined number of recording sheets and the like. The LD write circuit 110 generates a laser beam incident onto the photoreceptors 101-104.

Figure 2:
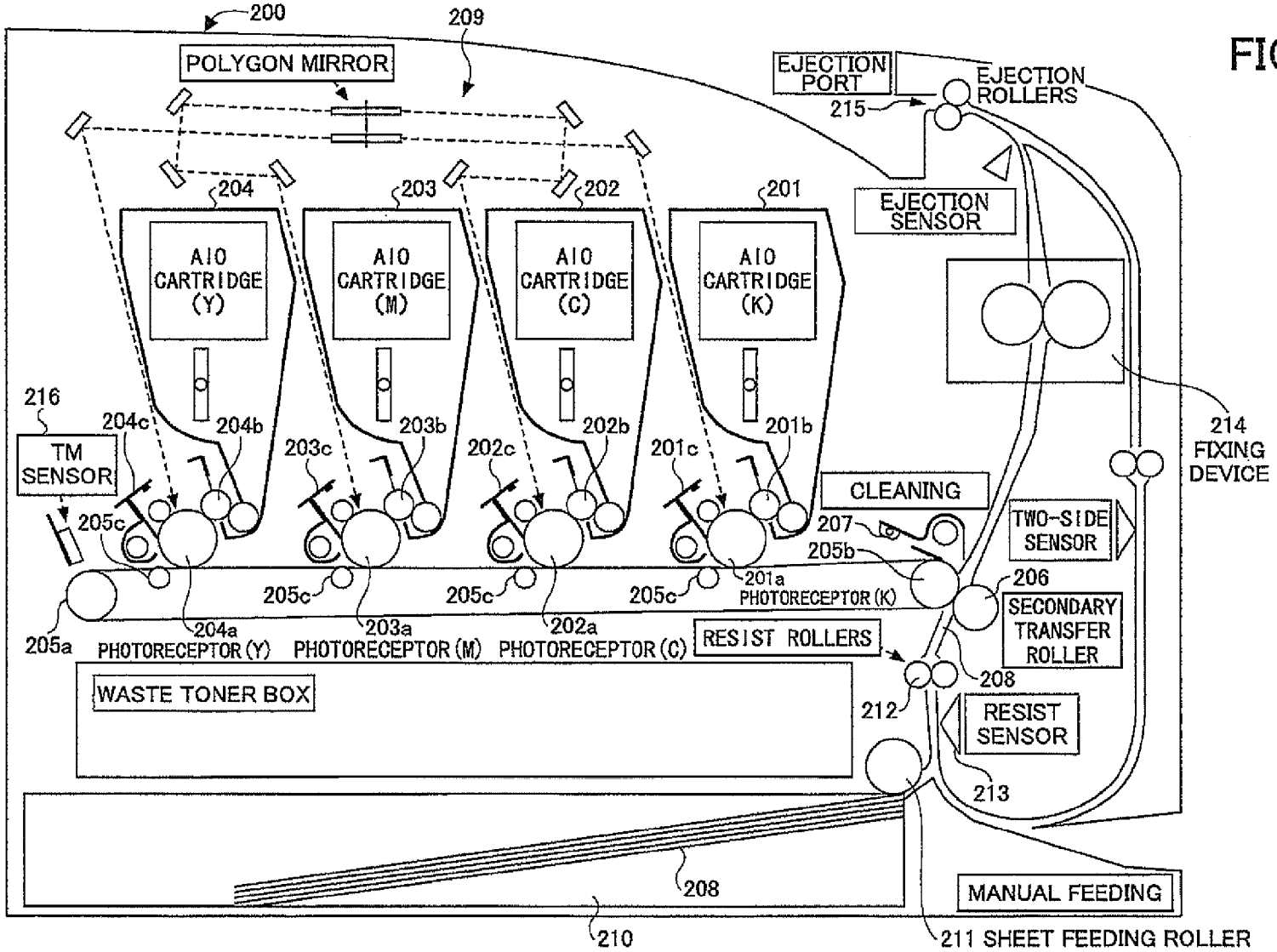
FIG. 2 is a side view showing an internal structure of a tandem-type full color printer which uses an electrophotographic process.

FIG. 2 relates to an example of the image forming apparatus according to the present embodiment, and is a side view showing the internal structure of a tandem-type full color printer which uses an electrophotographic process. In this example, AIO cartridges are used as process cartridges.

In an image forming apparatus 200, as shown in FIG. 2, an image forming part includes four AIO cartridges (an AIO cartridge (K) 201, an AIO cartridge (C) 202, an AIO cartridge (M) 203 and an AIO cartridge (Y) 204) each housing an image forming unit; a transfer belt disposed on the lower side of the AIO cartridges; and a secondary transfer bias roller 206 which serves as a secondary transfer member. Note that Y, M, C and K in parentheses indicate yellow, magenta, cyan and black, respectively.

Each of the four cartridges includes a cylindrical photoreceptor 201*a*, 202*a*, 203*a* and 204*a*, which is a freely rotatable image carrying body; a charging roller 201*b*, 202*b*, 203*b* and 204*b*; a developing device; and a cleaning device 201*c*, 202*c*, 203*c* and 204*c*. The charging roller 201*b*, 202*b*, 203*b* and 204*b*, the developing device and the cleaning device 201*c*, 202*c*, 203*c* and 204*c* are disposed around the corresponding photoreceptor 201*a*, 202*a*, 203*a* and 204*a* in order that the electrostatic image process proceeds. The four cartridges form toner images of different colors. The four photoreceptors 201*a*, 202*a*, 203*a* and 204*a* are disposed at even intervals.

In an image forming operation, the photoreceptors 201*a*, 202*a*, 203*a* and 204*a* are driven to rotate by a motor at a circumferential velocity of, for example, 120 mm/sec.

Each charging roller 201*b*, 202*b*, 203*b* and 204*b* abuts the photoreceptor 201*a*, 202*a*, 203*a* and 204*a*, and is rotated by the drive of the photoreceptor 201*a*, 202*a*, 203*a* and 204*a*. AC and DC biases (charging bias) are applied by a high-voltage power source to the charging roller 201*b*, 202*b*, 203*b* and 204*b*, which then uniformly charges the surface of the photoreceptor 201*a*, 202*a*, 203*a* and 204*a*. The charging biases are parameters for the image formation and are finely adjusted according to a recording sheet to be used.

Each developing device performs single-component development. With a predetermined developing bias supplied from a high-voltage power source, the developing device develops an electrostatic latent image formed on the surface of the photoreceptor 201*a*, 202*a*, 203*a* and 204*a* into a visible image, to thereby form a toner image. The developing bias is a parameter for the image formation and is finely adjusted according to a recording sheet to be used.

Each cleaning device 201*c*, 202*c*, 203*c* and 204*c* in the corresponding AIO cartridge cleans toner remaining on the surface of the photoreceptor 201*a*, 202*a*, 203*a* and 204*a* after the transfer operation.

The transfer belt 205 is supported with tension around a driving roller 205*a* and a supporting roller 205*b*. The transfer belt 205 is also driven to rotate by a motor.

Four primary transfer bias rollers 205*c* which serve as primary transfer members are provided inside the transfer belt 205. The four primary transfer bias rollers 205*c* are disposed opposite to transfer positions of the respective photoreceptors 201*a*, 202*a*, 203*a* and 204*a* along the transfer belt 205. A primary transfer bias is applied to each primary transfer bias roller 205*c* by a primary transfer bias applying unit, whereby the primary transfer bias roller 205*c* transfers a toner image formed on the surface of the corresponding photoreceptor onto the surface of the transfer belt 205. Note that the primary transfer bias applying unit is a high-voltage power source.

A cleaning device 207 for cleaning the transfer belt 205 is provided close to the supporting roller 205*b*.

A TM sensor 216 detects a toner mark pattern formed on the transfer belt 205. The detected toner mark pattern is used by a color misregistration determining unit to determine whether color misregistration is present. If the color misregistration determining unit determines the presence of color misregistration, a color misregistration correcting unit performs a color misregistration correcting operation.

The secondary transfer bias roller 206 is disposed opposite to the supporting roller 205*b* across the transfer belt 205. A secondary transfer bias is applied to the secondary transfer bias roller 206 by a secondary transfer bias applying unit, whereby the secondary transfer bias roller 206 transfers a toner image formed on the transfer belt 205 onto a recording sheet (a recording medium) 208 pinched between the secondary transfer bias roller 206 and the transfer belt 205. Note that the secondary transfer bias applying unit is a high-voltage power source. The primary and secondary transfer biases are parameters for the image forming and are finely adjusted according to a recording sheet to be used.

An optical writing unit 209 is disposed on the upper side of the four AIO cartridges, and emits a laser beam corresponding to image data of each color, Y, M, C and K, onto the surface of the corresponding photoreceptor to form an electrostatic latent image on the surface. The optical writing unit 209 shown here is of the laser scan type which uses a laser light source, a polygon mirror and the like. Note that the present invention is not limited to the laser scan type, and a system in which LED arrays and an imaging unit are combined may be employed.

Recording sheets 208 are housed in a sheet cassette 210, and a sheet feeding roller 211 separates the recording sheets 208 from each other and sends them out one by one. A single recording sheet 208 fed separately is conveyed to a secondary transfer position by resist rollers 212. The length of the recording sheet 208 in the sub-scanning direction is measured by a resist sensor 213.

A fixing device 214 fixes a toner image transferred to the recording sheet 208 by applying heat and pressure to the recording sheet 208. The fixing temperature is a parameter for the image formation and is finely adjusted according to the recording sheet 208.

According to the structure illustrated in FIG. 2, the secondary transfer bias roller 206 abuts the transfer belt 205. However, in the case where a contact and separating mechanism is provided, the secondary transfer bias roller 206 and the transfer belt 205 are separated from each other when jamming or the like occurs so that residual toner on the transfer belt 205 is not transferred to the secondary transfer bias roller 206.

The above tandem-type image forming apparatus forms a toner mark pattern used for detecting the presence or absence of color misregistration in a space between two recording sheets (hereinafter, referred to as "interspace") on the transfer belt 205, and determines whether color misregistration is present by detecting the toner mark pattern using the TM sensor 216. If the presence of color misregistration is determined, the image forming apparatus performs an operation for correcting the color misregistration, thereby achieving high-quality image formation.

Figure 3:
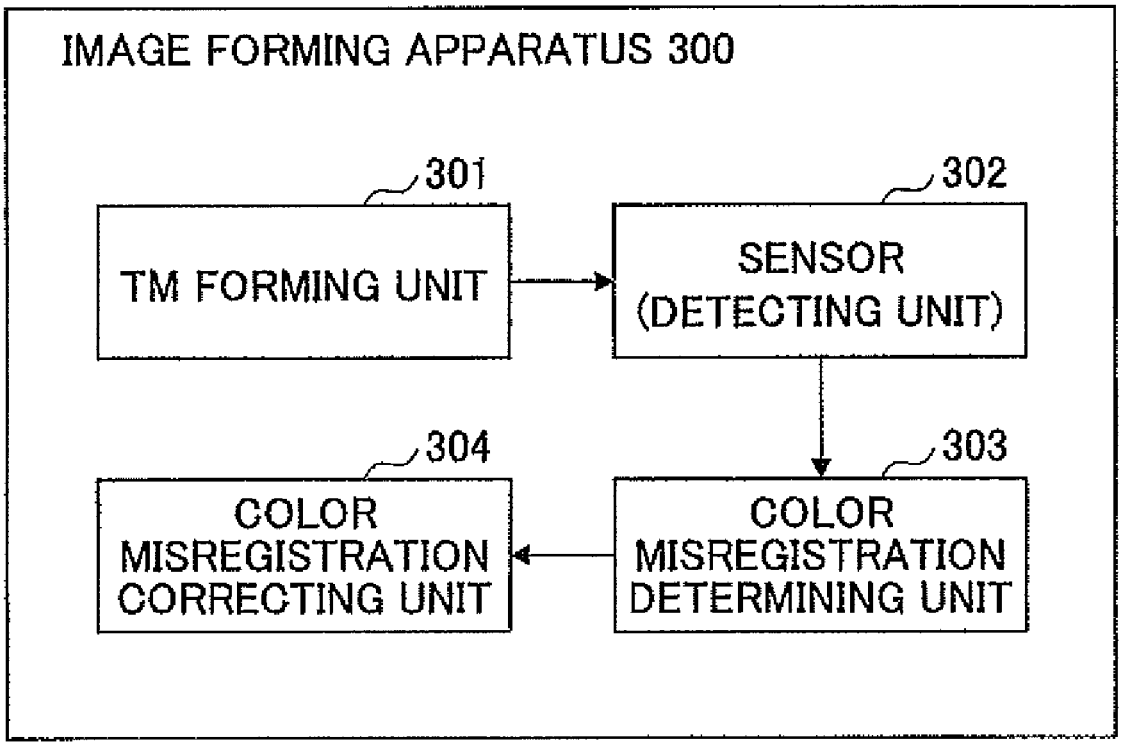
FIG. 3 is a functional block diagram related to color misregistration correction control of the image forming apparatus according to the embodiment.

FIG. 3 is a functional block diagram related to color misregistration correction control of the image forming apparatus according to the present embodiment. The color misregistration correction control of an image forming apparatus 300 is provided by a TM forming unit 301, a sensor (detecting unit) 302, a color misregistration determining unit 303 and a color misregistration correcting unit 304.

Figure 4:
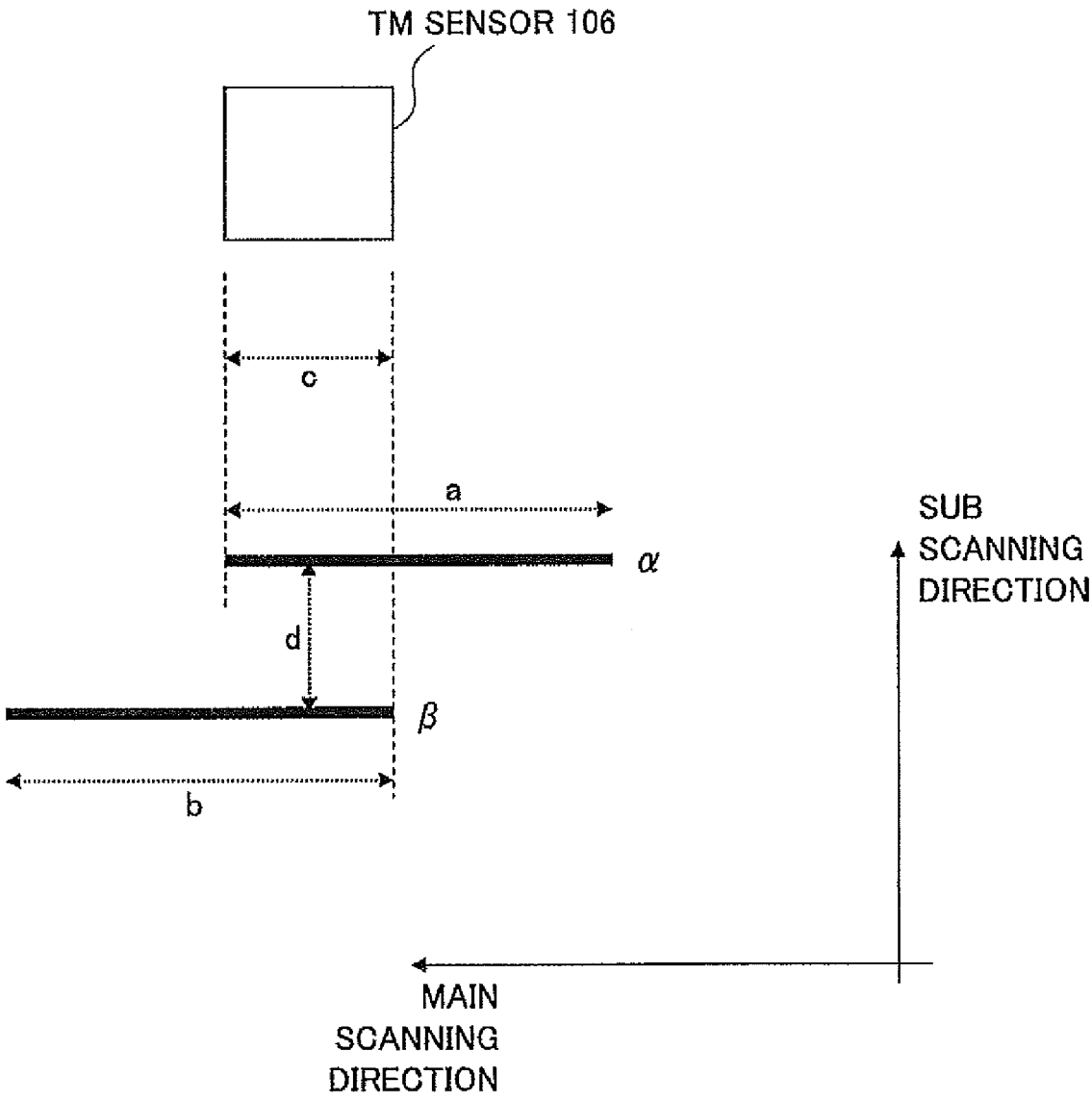
FIG. 4 shows an example of a toner mark pattern according to the embodiment.

The TM forming unit 301 forms a toner mark pattern in the interspace on the transfer belt. FIG. 4 shows an example of the toner mark pattern according to the present embodiment. The toner mark pattern is formed of a pair of lines, toner marks, that are parallel in the main scanning direction and disposed at different positions (i.e. coordinates) in the sub-scanning direction. With referring to FIG. 4, it is understood that each toner mark has their ends at different positions (coordinates) in the main scanning direction with respect to the ends of the other toner mark.

A toner mark $\alpha$ extends from the left edge of a spot of the TM sensor toward the right, and a toner mark $\beta$ extends from the right edge of the spot of the TM sensor toward the left. When the lengths of the toner marks $\alpha$ and $\beta$ are a and b, respectively, it is preferable that both a and b are twice or more a spot size c of the TM sensor. The reason is described later.

Note that, in the example of FIG. 4, the toner marks $\alpha$ and $\beta$ overlap in the sub-scanning direction by the amount corresponding to the spot size of the TM sensor; however, the present invention is not limited to this case, and the overlapping amount may be changed. Accordingly, it is possible to change the distance to be checked for the presence or absence of color misregistration in the main scanning direction. In addition, the toner mark pattern is formed in the interspace on the transfer belt in the embodiment; however, the present invention is not limited to this case.

A distance d between the toner marks $\alpha$ and $\beta$ should be provided that is sufficient to allow the TM sensor to detect the individual toner marks $\alpha$ and $\beta$. In addition, the two toner marks $\alpha$ and $\beta$ do not have to be parallel to each other in a strict manner. Also, it is understood that the positions of the toner marks $\alpha$ and $\beta$ may be swapped.

Referring back to FIG. 3, the sensor (detecting unit) 302 detects the toner mark pattern on the transfer belt and outputs detection results of the toner mark pattern to the color misregistration determining unit 303. The positions of the toner marks $\alpha$ and $\beta$ on the transfer belt and their relationship with the sensor detection results are described next with reference to FIGS. 5-8.

Figure 5B:
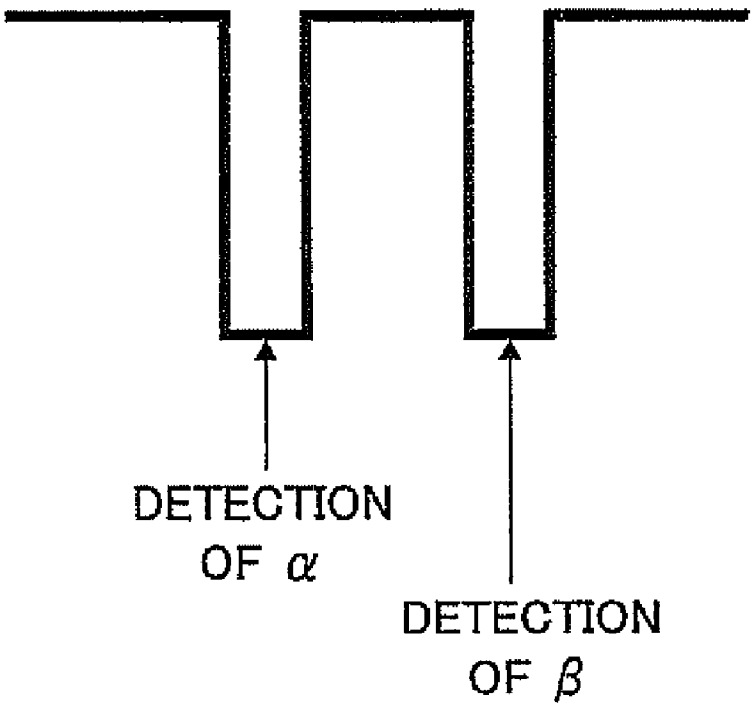
FIGS. 5A and 5B show the relationship between toner mark positions on a transfer belt and sensor output results.
Figure 5A:
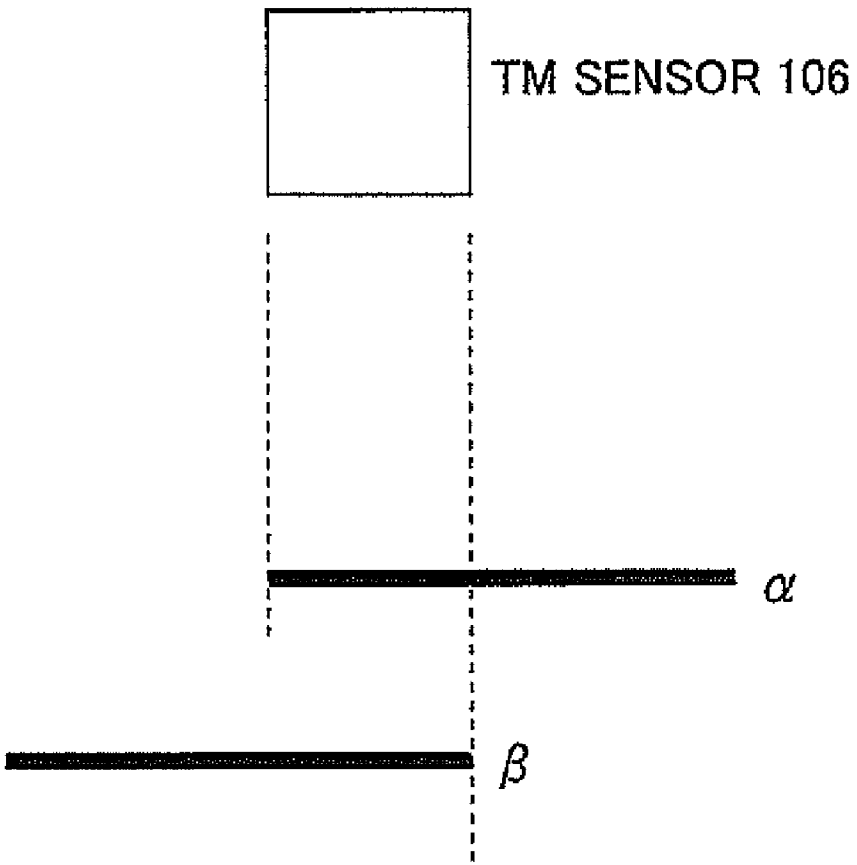

FIG. 5A shows an example in which color misregistration in the main scanning direction is absent. FIG. 5B shows detection results obtained when the sensor reads the toner mark pattern of FIG. 5A. According to FIG. 5B, it can be seen that both the toner marks $\alpha$ and $\beta$ were successfully detected. Therefore, it is determined that color misregistration is absent.

Figure 6B:
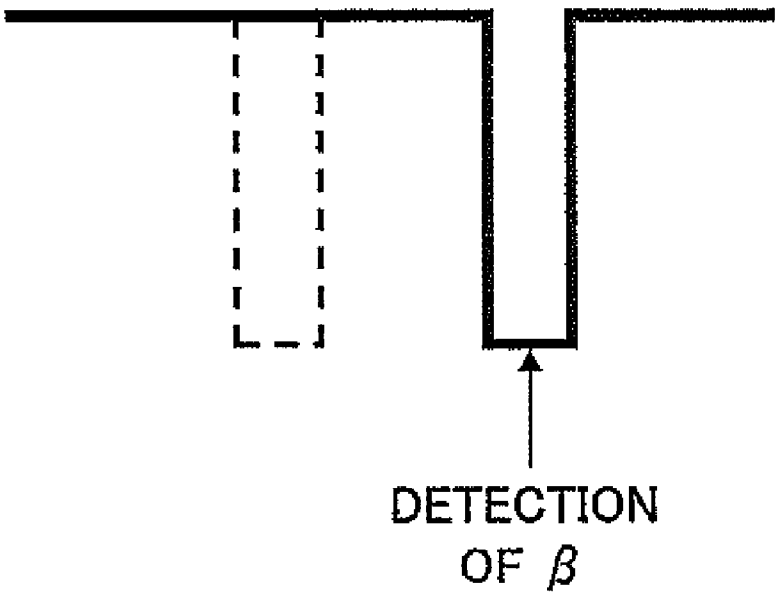
FIGS. 6A and 6B show the relationship between toner mark positions on the transfer belt and sensor output results.
Figure 6A:
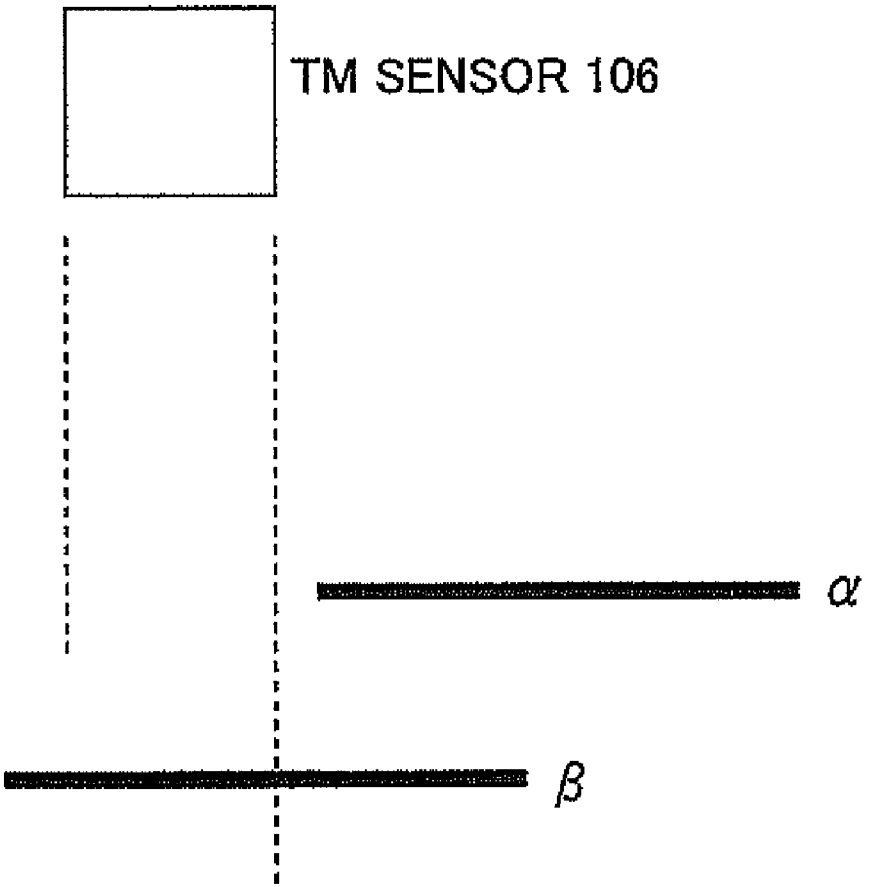

On the other hand, FIG. 6A shows an example in which the toner mark pattern is largely displaced to the right. FIG. 6B shows detection results obtained when the sensor reads the toner mark pattern of FIG. 6A. According to FIG. 6B, it can be seen that the toner mark $\alpha$ failed to be detected. Therefore, it is determined that color misregistration is present with the displacement of the toner mark pattern to the right by the amount equal to or greater than the spot size.

Figure 7B:
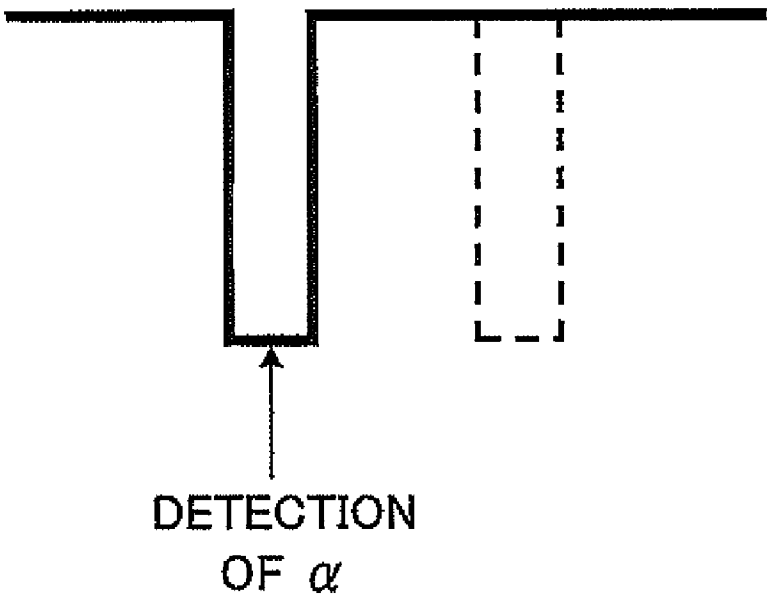
FIGS. 7A and 7B show the relationship between toner mark positions on the transfer belt and sensor output results.
Figure 7A:
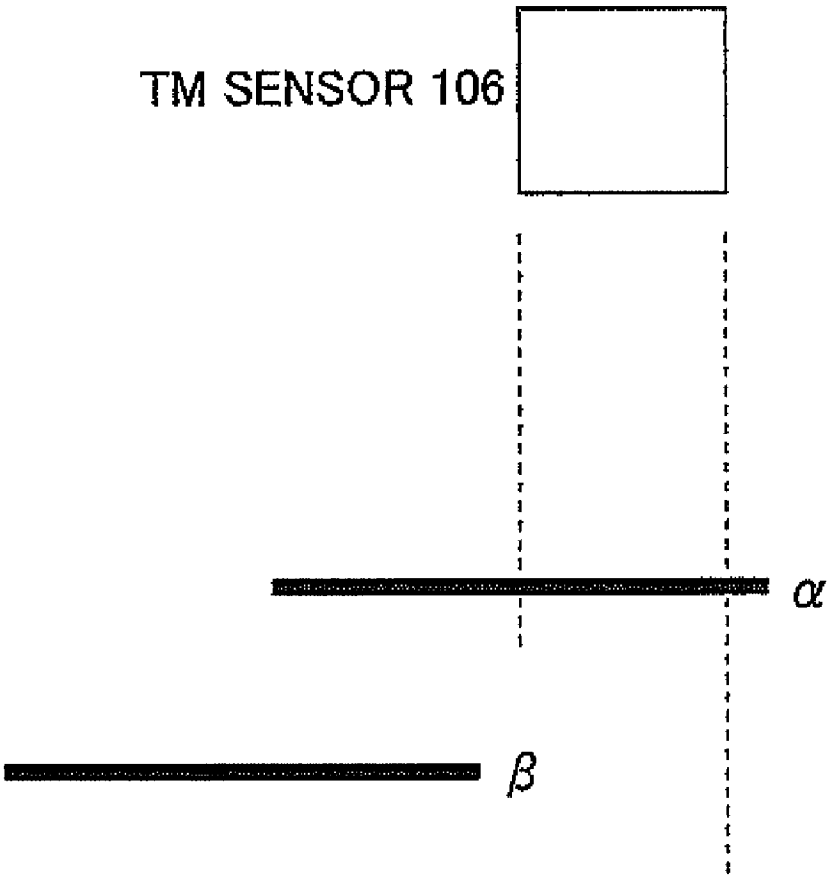

Next, FIG. 7A shows an example in which the toner mark pattern is largely displaced to the left FIG. 7B shows detection results obtained when the sensor reads the toner mark pattern of FIG. 7A. According to FIG. 7B, it can be seen that the toner mark β failed to be detected. Therefore, it is determined that color misregistration is present with the displacement of the toner mark pattern to the left by an amount equal to or greater than the spot size.

Figure 8B:
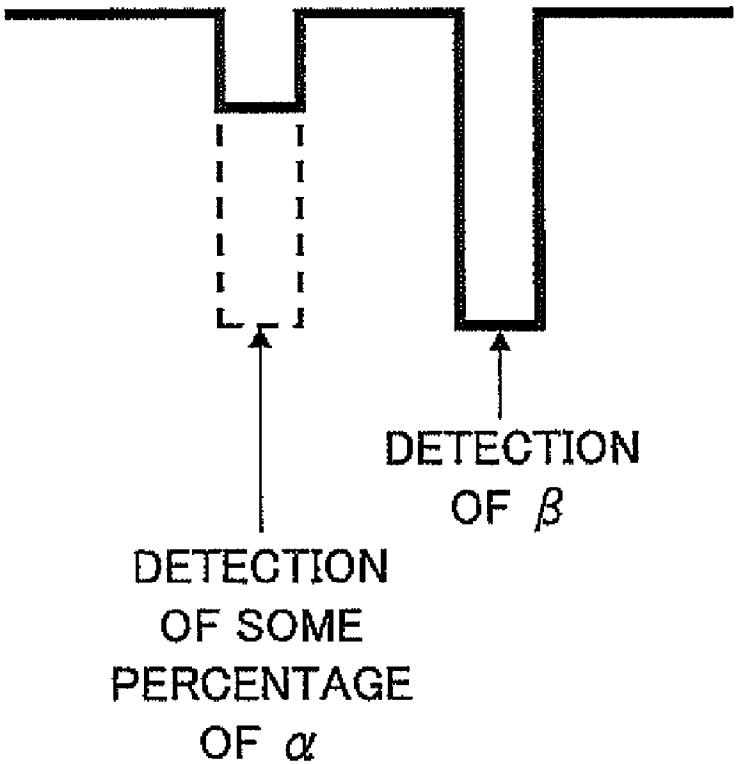
FIGS. 8A and 8B show the relationship between toner mark positions on the transfer belt and sensor output results.
Figure 8A:
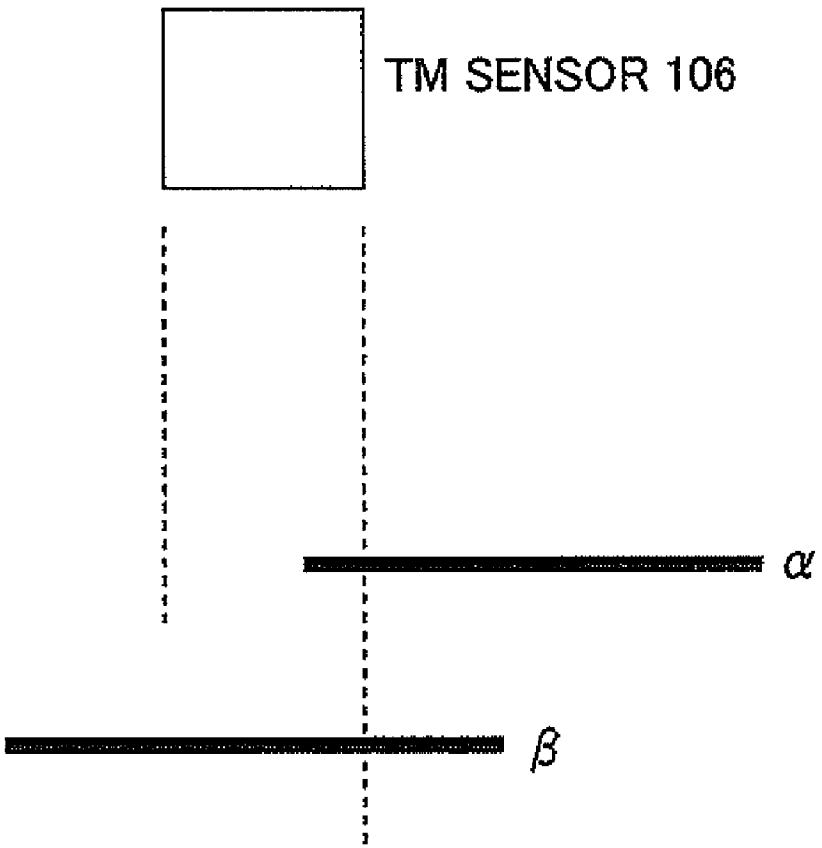

FIG. 8A shows an example in which the toner mark pattern is slightly displaced to the right. FIG. 8B shows detection results obtained when the sensor reads the toner mark pattern of FIG. 8A. According to FIG. 8B, it can be seen that, although both the toner marks α and β were detected, the detection result of the toner mark α is smaller than that of the toner mark β. In such a case, calculation is made to obtain a percentage of the detection result of the toner mark α to that of the toner mark β. If it is 50% or more, color misregistration is determined to be absent.

Note that if the length of each toner mark α and β is twice or more the spot size of the TM sensor, at least one of the toner marks α and β can be unfailingly detected even if, for example, the toner mark pattern is displaced either to the left or to the right by the amount equal to the spot size. Accordingly, it is possible to determine the presence or absence of color misregistration in a more reliable fashion.

Referring back to FIG. 3, the color misregistration determining unit 303 determines color misregistration based on the detection results of the sensor. Conditions used for determining the presence or absence of color misregistration are explained with reference to FIG. 9. FIG. 9 shows the conditions used by the color misregistration determining unit 303 to determine the presence or absence of color misregistration.

Condition 1: at least one of the toner marks α and β failed to be detected.

Condition 2: the toner mark α was successfully detected but the detection result of the toner mark β was 50% or less than that of the toner mark α.

Condition 3: the toner mark β was successfully detected but the detection result of the toner mark α was 50% or less than that of the toner mark β.

The color misregistration determining unit 303 determines the presence of color misregistration in the main scanning direction in the case where one of the above conditions is met, and directs the color misregistration correcting unit 304 to correct the color misregistration.

Note that a value of 50% is used as the threshold for Conditions 2 and 3; however, the present invention is not limited to this case, and it is understood that an arbitrary value can be used.

Figure 10:
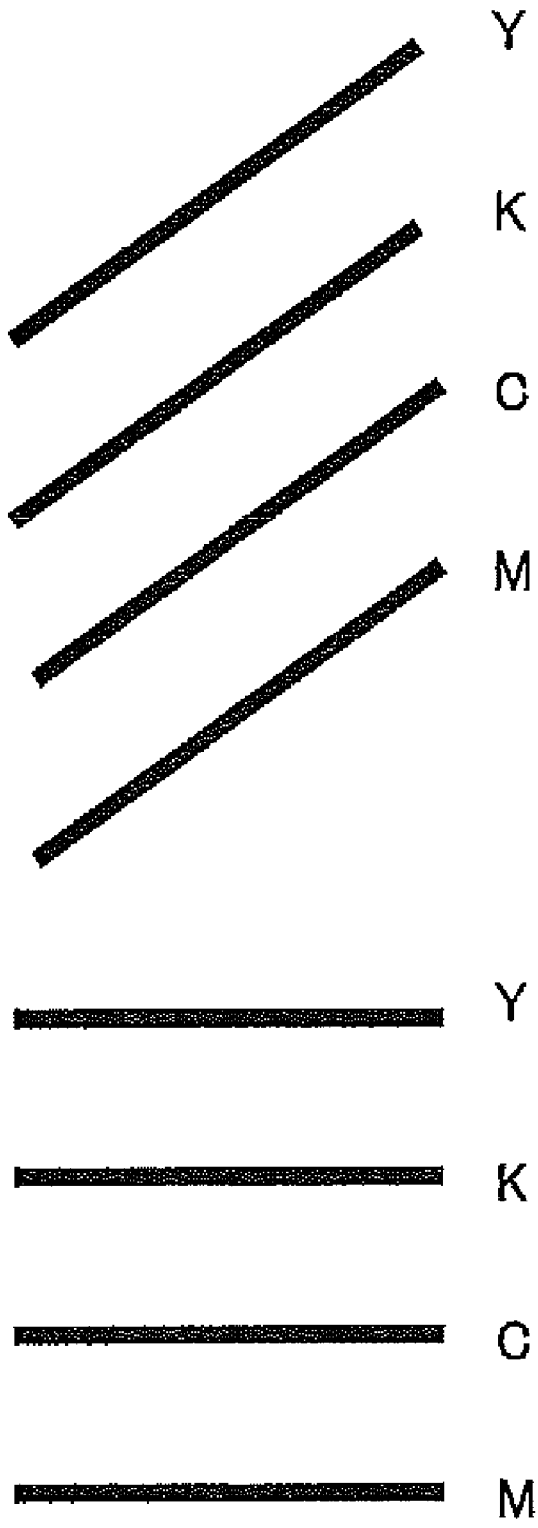
FIG. 10 shows an example of a toner mark pattern used in a conventional method.

In response to the direction of the color misregistration determining unit 303, the color misregistration correcting unit 304 performs an operation for correcting the color misregistration using a conventional method. FIG. 10 shows a toner mark pattern used in conventional color misregistration correction ("the second toner mark pattern" as defined in the appended claims). The conventional method achieves color misregistration correction basically by calculating positional displacement both in the main scanning direction and in the sub-scanning direction with the use of the toner mark pattern shown in FIG. 10 and subsequently adjusting timing for writing an image of each color or the like.

Figure 11:
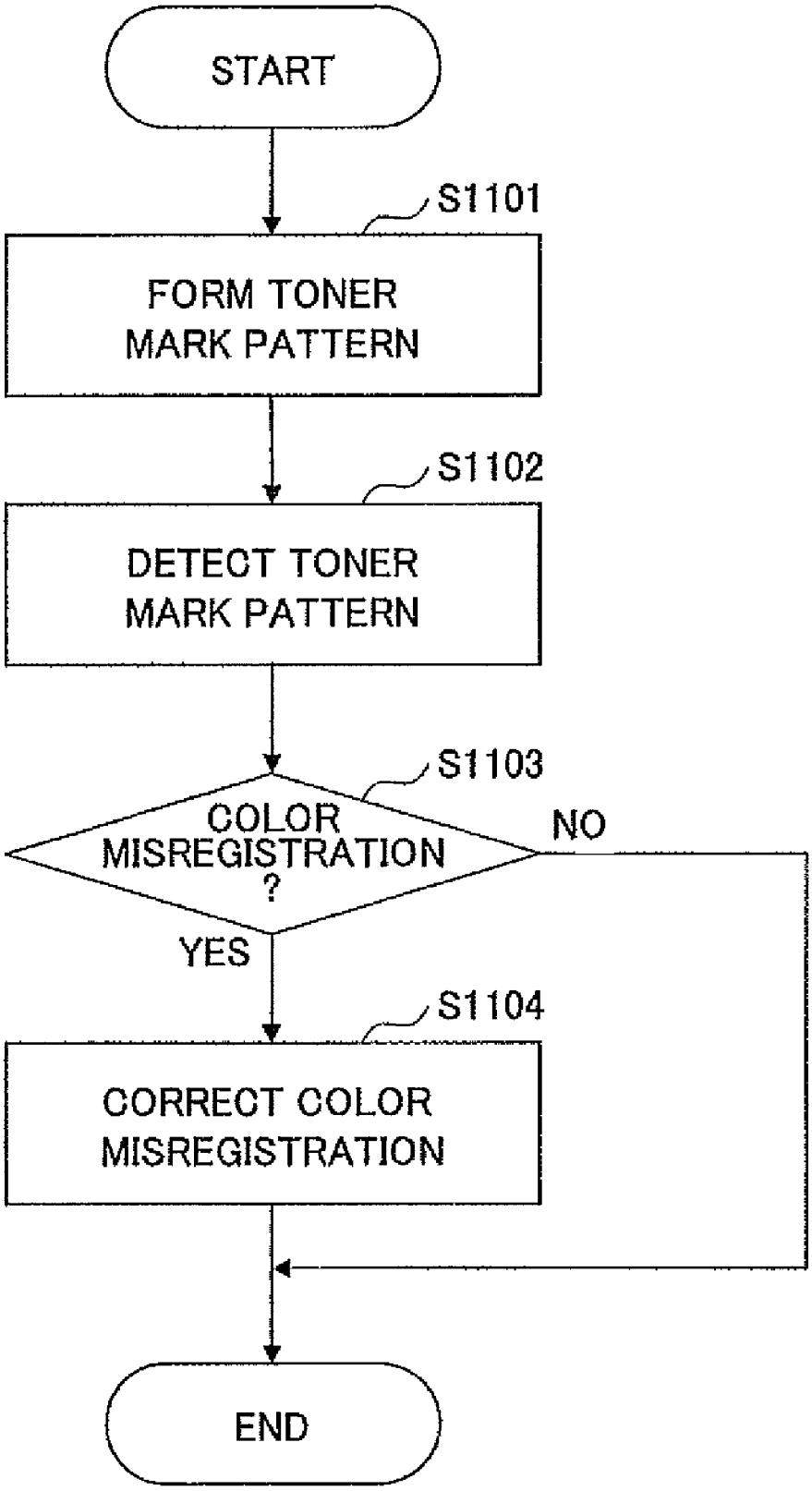
FIG. 11 is a flowchart showing a process of controlling color misregistration correction according to the embodiment.

FIG. 11 is a flowchart showing a process of controlling color misregistration correction according to the present embodiment. In Step S1101, the TM forming unit 301 forms, in the interspace on the transfer belt, the toner mark pattern including a pair of toner marks used for detecting the presence or absence of color misregistration in the main scanning direction.

Next, in Step S1102, the sensor (detecting unit) 302 reads the toner mark pattern on the transfer belt and outputs detection results. Then, in Step S1103, the color misregistration determining unit 303 determines the presence or absence of color misregistration based on the detection results of the sensor (detecting unit) 302.

If the presence of color misregistration is determined (Step S1103: YES), the process moves to Step S1104, and the color misregistration correcting unit 304 performs the operation for correcting the color misregistration.

As has been described above, according to the embodiment of the present invention, the presence or absence of color misregistration in the main scanning direction is readily determined by forming in the interspace on the transfer belt the novel toner mark pattern including a pair of toner marks. Even in continuous printing, since the presence or absence of color misregistration in the main scanning direction is determined by the simple method, the continuous printing operation is not affected unless the presence of color misregistration is detected. In addition, the toner marks of the toner mark pattern are parallel to the main scanning direction, thus requiring less space as compared to conventional toner mark patterns (e.g. the toner mark pattern shown in the upper part of FIG. 10) used for detecting the presence or absence of color misregistration in the main scanning direction.

(b) Modifications

Next are described modifications of the above-described embodiment.

Figure 12:
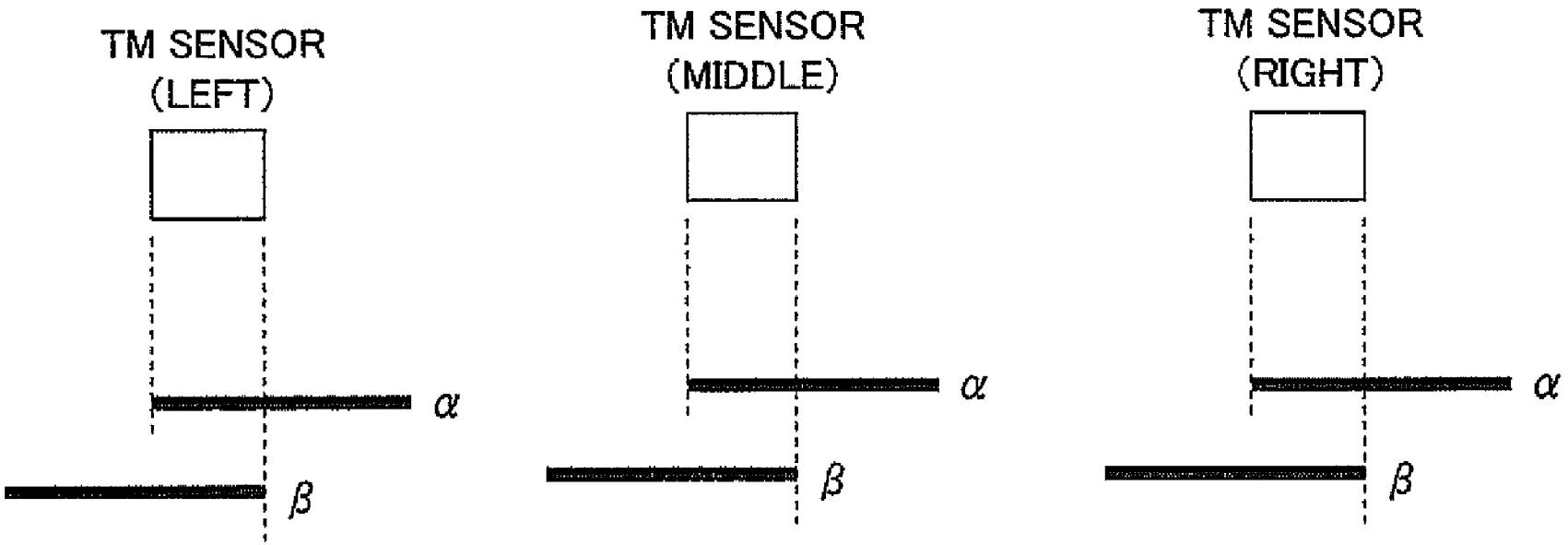
FIG. 12 shows an example of using three TM sensors according to a first modification.

Although one TM sensor is employed in the above embodiment, according to the first modification, multiple TM sensors are disposed in the width direction of the transfer belt in order to determine the presence or absence of color misregistration at different positions. FIG. 12 shows an example of using three TM sensors. The presence or absence of color misregistration in the main scanning direction is determined at the disposed positions of the left, middle and right TM sensors. In this case, color misregistration correction may be performed if the presence of color misregistration is detected at at least one of these positions, or if the presence of color misregistration is detected at all the positions.

In the above-described manner, the presence or absence of color misregistration in the main scanning direction can be determined at the disposed position of each sensor by using multiple TM sensors.

Figure 13:
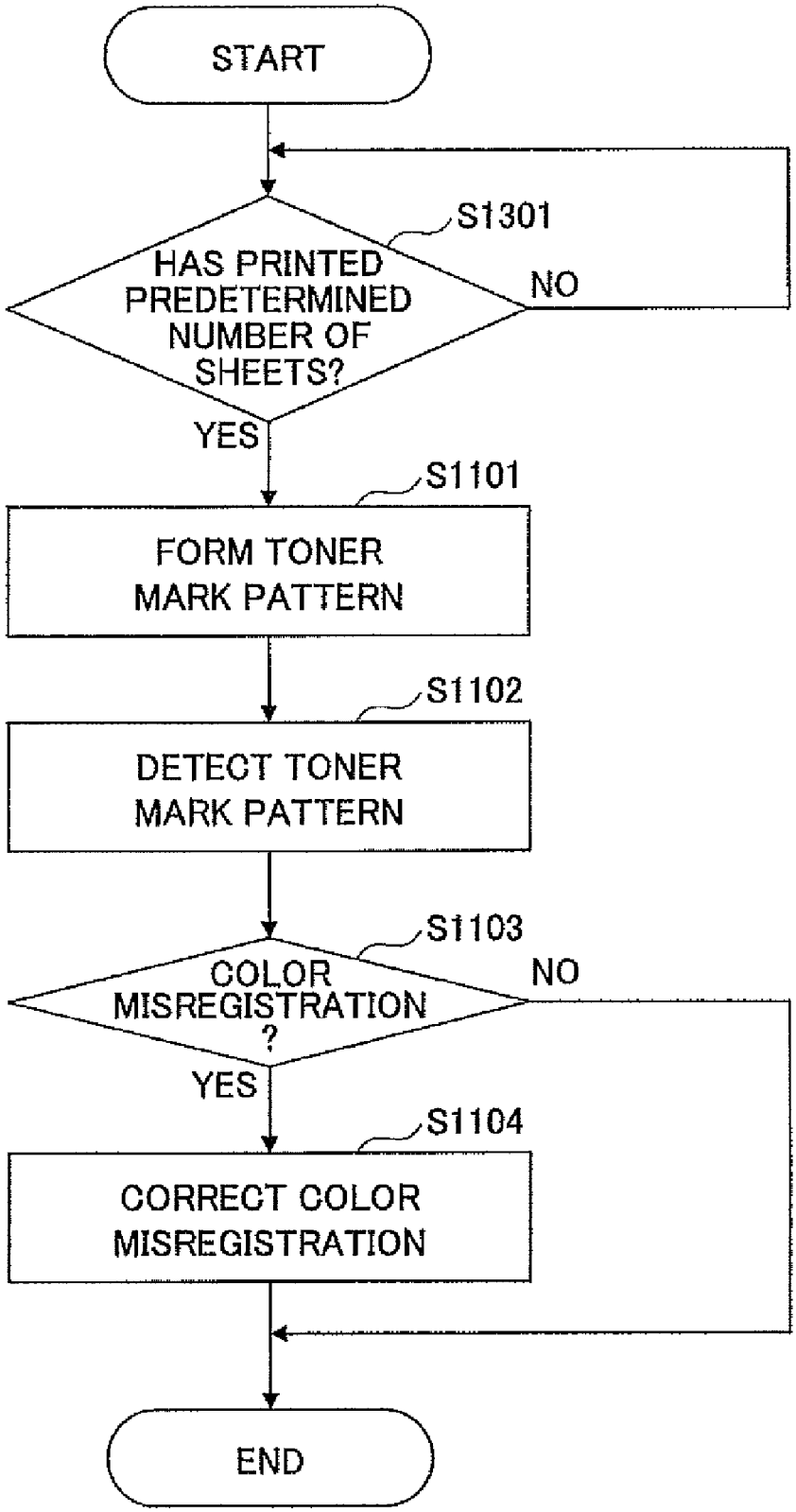
FIG. 13 is a flowchart showing a process of controlling color misregistration correction according to a second modification.

The above embodiment does not particularly mention a frequency of forming the toner mark pattern. According to the second modification, however, the toner mark pattern is formed in the interspace on the transfer belt once every predetermined number of recording sheets. A process of controlling color misregistration correction in this case is explained with reference to FIG. 13. In FIG. 13, the same step numbers are given to the steps which are common to those of FIG. 11, and their explanations are omitted.

In Step S1301, a print determining unit determines whether a predetermined number of recording sheets are printed. Note that the predetermined number may be assigned by the user, or may be set in advance.

In the case of NO in Step S1301, the process returns to Step S1301. If YES in Step S1301, the process moves to Step S1101, and the process steps common to those of FIG. 11 are subsequently performed.

Accordingly, the toner mark pattern is formed once every predetermined number of recording sheets rather than being formed for each printing operation. In this way, it is possible to determine the presence or absence of color misregistration in the main scanning direction at appropriate frequencies.

Note that in the case where the user assigns a number to the predetermined number of recording sheets, the assigned number may be recorded in a nonvolatile memory, and in subsequent printing operations, the toner mark pattern may be formed after recording sheets equal to the number recorded in the memory are printed.

The first embodiment does not particularly mention the number of toner mark pairs formed in the interspace on the transfer belt. According to the third modification, however, the extent (i.e. length) of the interspace is calculated and the number of toner mark pairs is determined according to the calculated interspace length.

Figure 14:
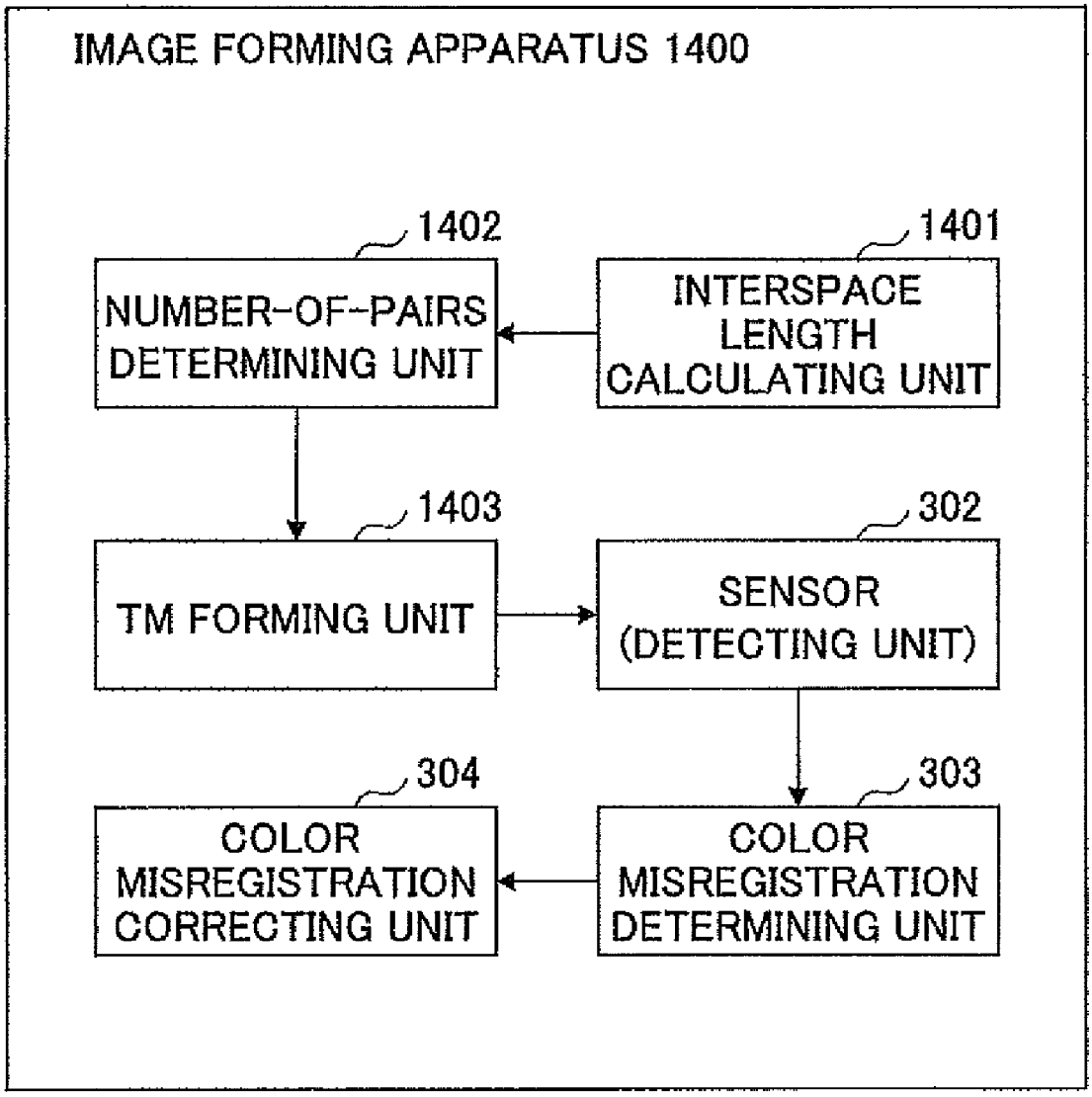
FIG. 14 is a functional block diagram related to color misregistration correction control of an image forming apparatus according to a third modification.

FIG. 14 is a functional block diagram of the third modification in which the interspace length is calculated. In FIG. 14, the same reference numerals are given to the components which are common to those of FIG. 3, and their explanations are omitted.

An interspace length calculating unit 1401 calculates the interspace length based on recording sheets to be used and a linear velocity. The interspace length calculating unit 1401 also outputs the calculated interspace length to a number-of-pairs determining unit 1402.

After obtaining the calculated interspace length from the interspace length calculating unit 1401, the number-of-pairs determining unit 1402 determines the number of toner mark pairs to be formed according to the obtained interspace length. Also, the number-of-pairs determining unit 1402 outputs the determined number of pairs to the TM forming unit 1403.

The TM forming unit 1403 forms on the transfer belt the number of toner mark pairs equal to the number of pairs output from the number-of-pairs determining unit 1402.

Figure 15:
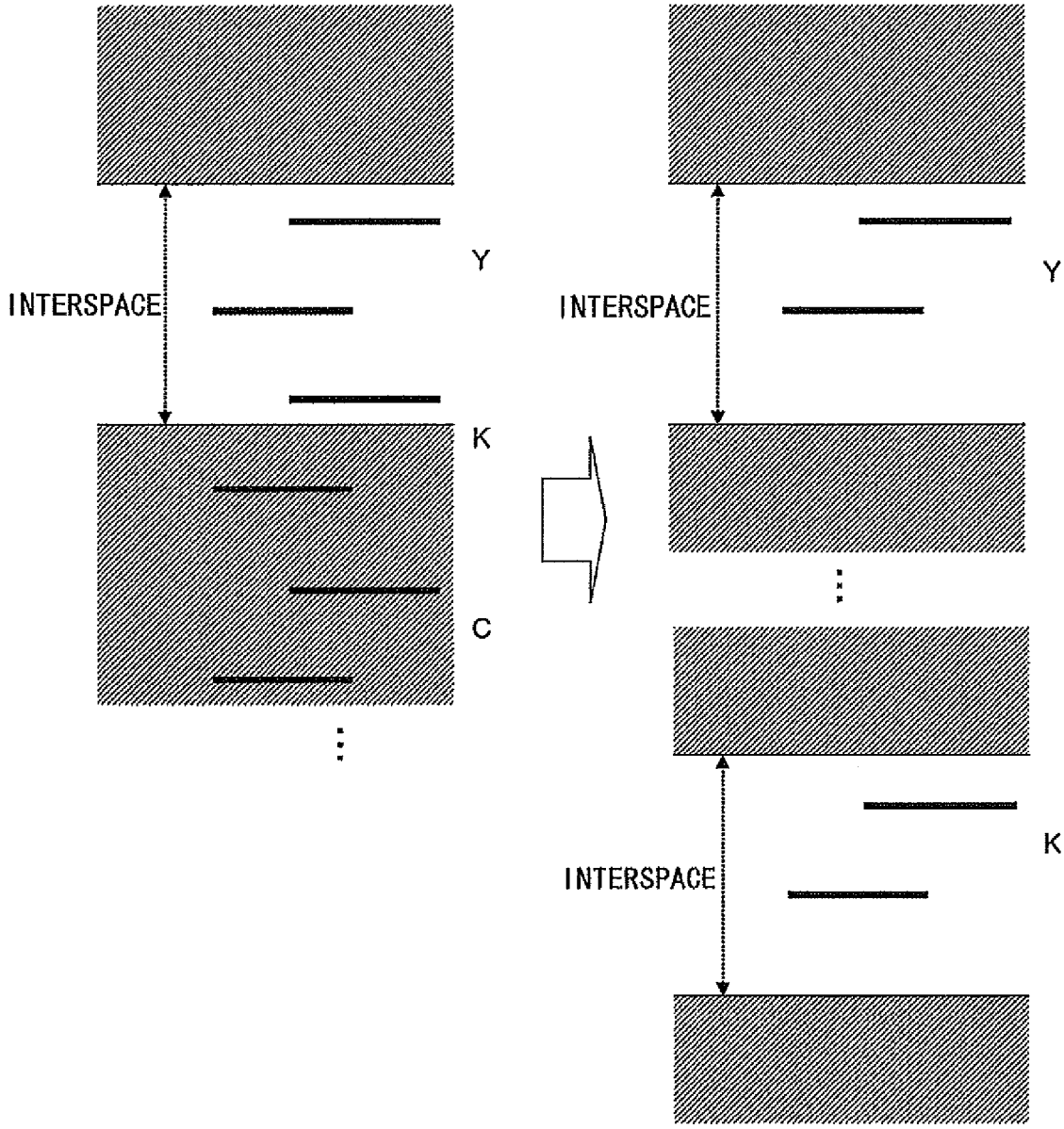
FIG. 15 shows the relationship between the interspace length and the toner mark pattern according to the third modification.

The relationship between the interspace length and the number of toner mark pairs is described with reference to FIGS. 15 and 16. FIG. 15 shows an example in which the interspace length is so small that only one pair of toner marks can be fit. In this case, only one pair of toner marks is formed in the interspace.

Figure 16:
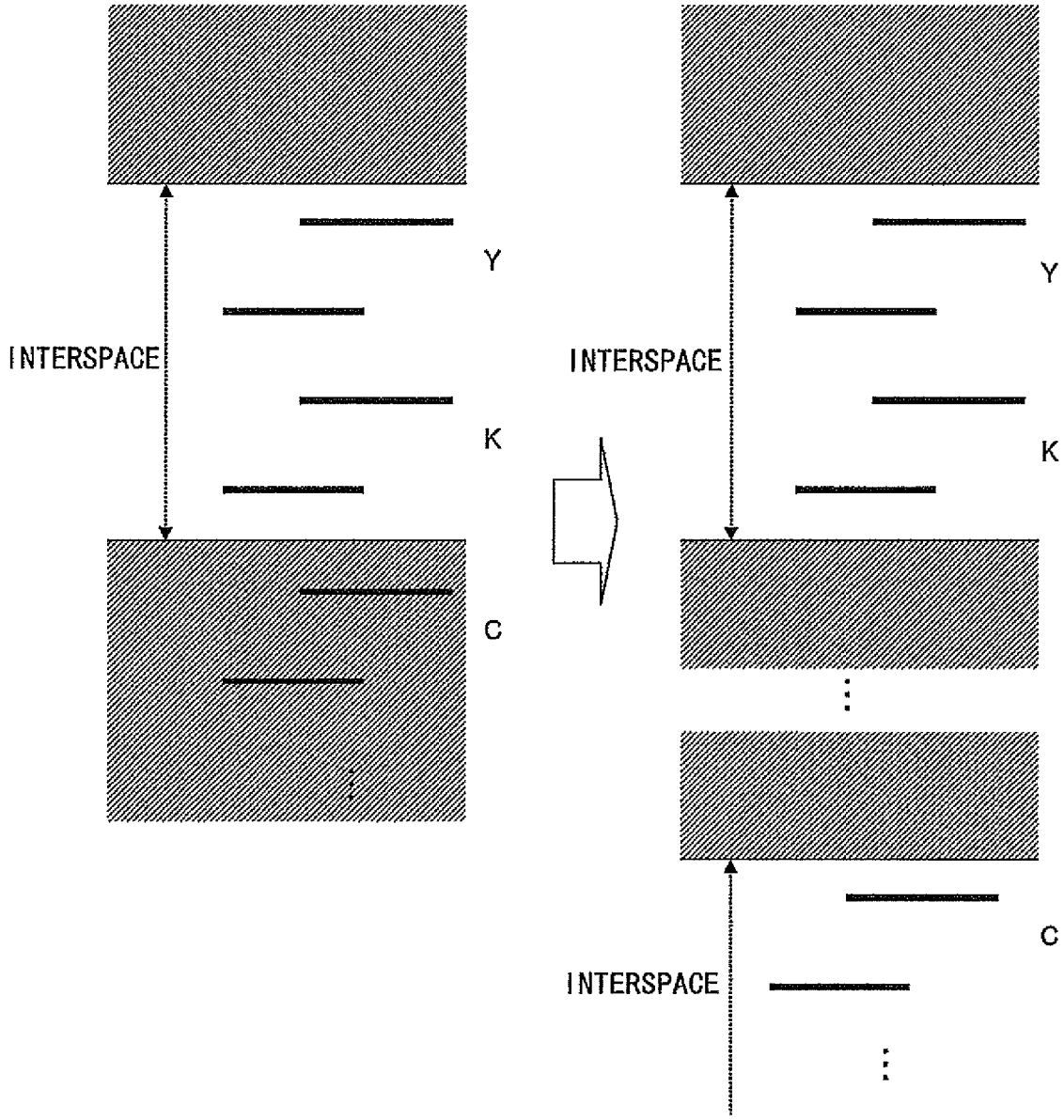
FIG. 16 shows the relationship between the interspace length and the toner mark pattern according to the third modification.

FIG. 16 shows an example in which two pairs of toner marks can be fit in the interspace. In this case, two pairs of toner marks are formed in the interspace.

Figure 17:
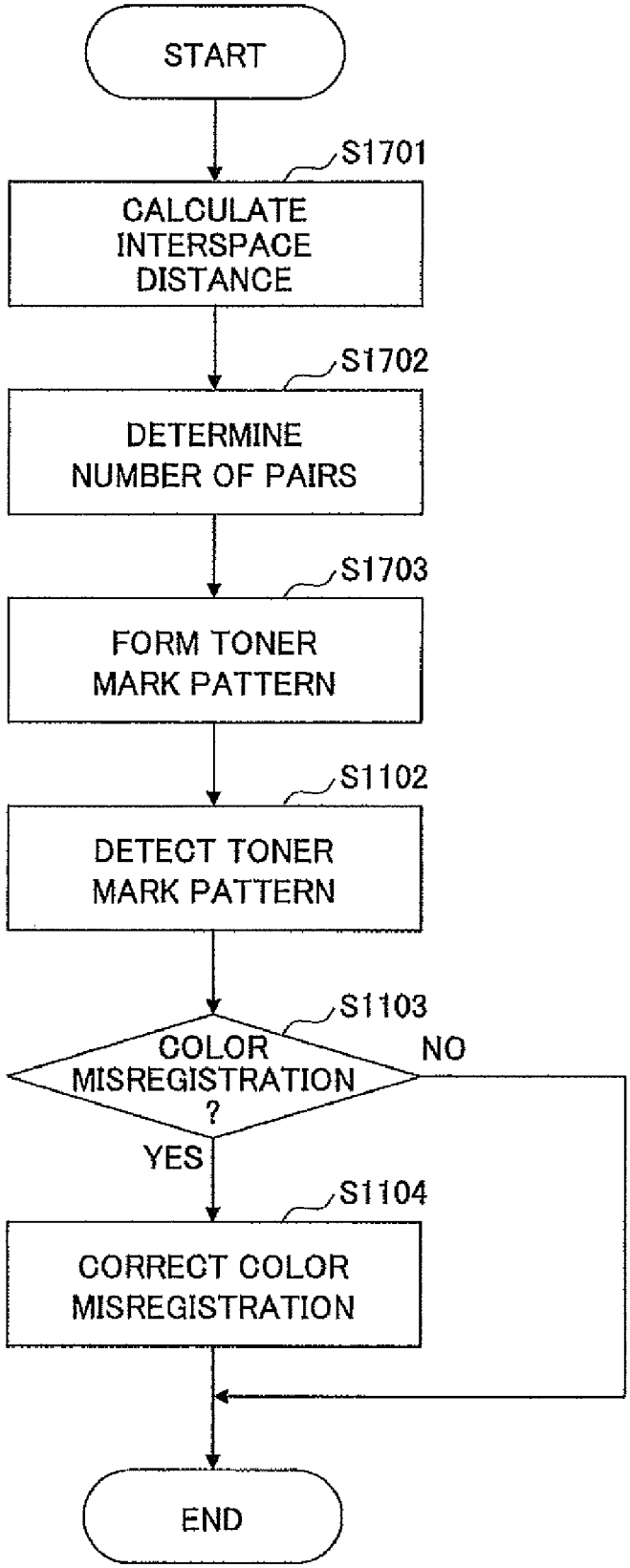
FIG. 17 is a flowchart showing a process of controlling color misregistration correction according to the third modification.

FIG. 17 is a flowchart showing a process of controlling color misregistration correction according to the third modification 3. In FIG. 17, the same step numbers are given to the steps which are common to those of FIG. 11, and their explanations are omitted.

In Step S1701, the interspace length calculating unit 1401 calculates the length of the interspace based on recording sheets to be used and a linear velocity. Next, in Step S1702, the number-of-pairs determining unit 1402 determines the number of toner mark pairs to be formed in the interspace based on the interspace length calculated by the interspace length calculating unit 1401. Then, in Step S1703, the TM forming unit 1403 forms on the transfer belt the number of toner mark pairs equal to the number of pairs determined by the number-of-pairs determining unit 1402.

In this manner, the interspace length is calculated, whereby it is possible to form the number of toner mark pairs suitable for the interspace length. The interspace length calculated by the interspace length calculating unit 1401 is used for the formation of the toner mark pattern, which is utilized for detecting the presence or absence of color misregistration in the main scanning direction, but may also be used for the formation of the conventional toner mark pattern utilized by the color misregistration correcting unit 304. Accordingly, after the presence of color misregistration in the main scanning direction is determined, a suitable number of toner mark pairs used for correcting the color misregistration can be formed in accordance with the interspace length.

Thus, the present invention has been described in detail herein with reference to preferred embodiments thereof. While the present invention has been shown and described with particular examples, it should be understood that various changes and modification may be made to the particular examples without departing from the scope of the broad spirit and scope of the present invention as defined in the claims. That is, the scope of the present invention is not limited to the particular examples and the attached drawings.

This application is based on Japanese Patent Application No. 2008-046747 filed on Feb. 27, 2008, the contents of which are hereby incorporated herein by reference.

What is claimed is:

1. A tandem-type image forming apparatus comprising:

a toner mark pattern forming unit configured to form a toner mark pattern on a transfer belt;

a sensor configured to detect the toner mark pattern;

a first determining unit configured to determine a presence or absence of color misregistration based on a result of the detection obtained by the sensor; and a color misregistration correcting unit configured to correct the color misregistration based on a result of the determination obtained by the first determining unit;

wherein the toner mark pattern formed by the toner mark pattern forming unit includes a pair of toner marks which are disposed at different coordinates in a sub-scanning direction, one of the paired toner marks having ends thereof at different coordinates in a main scanning direction with respect to ends of the other one of the paired toner marks, and the first determining unit determines the presence or absence of the color misregistration in the main scanning direction based on the result of the detection of the paired toner marks obtained by the sensor.

2. The image forming apparatus as claimed in claim 1, wherein part of each of the paired toner marks share a common coordinate span in the main scanning direction.

3. The image forming apparatus as claimed in claim 2, wherein the shared common coordinate span in the main scanning direction corresponds to an amount equal to a spot size of the sensor.

4. The image forming apparatus as claimed in claim 1, wherein length of each of the paired toner marks is twice or more a spot size of the sensor.

5. The image forming apparatus as claimed in claim 1, wherein if the first determining unit determines the presence of the color misregistration in the main scanning direction, the toner mark pattern forming unit forms a second toner mark pattern having a different configuration compared to the toner mark pattern including the paired toner marks, and the color misregistration correcting unit corrects the color misregistration based on a detection result of the second toner mark pattern obtained by the sensor.

6. The image forming apparatus as claimed in claim 1, further comprising a plurality of the sensors, wherein the toner mark pattern forming unit forms the paired toner marks at positions on the transfer belt, each of the positions corresponding to a disposed position of a different one of the sensors, and the first determining unit determines the presence or absence of the color misregistration at each of the positions.

7. The image forming apparatus as claimed in claim 1, further comprising a setting unit configured to set a predetermined number, wherein the toner mark pattern forming unit forms the toner mark pattern including the paired toner marks once each time after recording sheets of the predetermined number are printed.

8. The image forming apparatus as claimed in claim 1, further comprising a calculating unit configured to calculate a distance between two consecutive recording sheets on the transfer belt; and a second determining unit configured to determine, according to the distance calculated by the calculating unit, what number of the paired toner marks are to be formed; wherein the toner mark pattern forming unit forms the number of paired toner marks determined by the second determining unit.

9. An image forming method comprising:

a toner mark pattern forming step of forming a toner mark pattern on a transfer belt;

a detecting step of detecting the toner mark pattern by a sensor;

a first determining step of determining presence or absence of color misregistration based on a result of the detection obtained by the sensor; and a color misregistration correcting step of correcting the color misregistration based on a result of the determination obtained in the first determining step;

wherein the toner mark pattern formed in the toner mark pattern forming step includes a pair of toner marks which are disposed at different coordinates in a sub-scanning direction, one of the paired toner marks having ends thereof at different coordinates in a main scanning direction with respect to ends of the other one of the paired toner marks, and the first determining step determines the presence or absence of the color misregistration in the main scanning direction based on the result of the detection of the paired toner marks obtained by the sensor.

10. The image forming method as claimed in claim 9, wherein the paired toner marks extend in length in the main scanning direction and part of each of the paired toner marks share a common coordinate span in the main scanning direction.

11. The image forming method as claimed in claim 10, wherein the shared common coordinate span in the main scanning direction corresponds to an amount equal to a spot size of the sensor.

12. The image forming method as claimed in claim 9, wherein length of each of the paired toner marks is twice or more the spot size of the sensor.

13. The image forming method as claimed in claim 9, wherein if the first determining step determines the presence of the color misregistration in the main scanning direction, the toner mark pattern forming step forms a second toner mark pattern having a different configuration compared to the toner mark pattern including the paired toner marks, and the color misregistration correcting step corrects the color misregistration based on a detection result of the second toner mark pattern obtained by the sensor.

14. The image forming method as claimed in claim 9, wherein the image forming apparatus includes a plurality of the sensors, the toner mark pattern forming step forms the paired toner marks at positions on the transfer belt, each of the positions corresponding to a disposed position of a different one of the sensors, and the first determining step determines the presence or absence of the color misregistration at each of the positions.

15. The image forming method as claimed in claim 9, further comprising a setting step of setting a predetermined number, wherein the toner mark pattern forming step forms the toner mark pattern including the paired toner marks once each time after recording sheets of the predetermined number are printed.

16. The image forming method as claimed in claim 9, further comprising a calculating step of calculating a distance between two consecutive recording sheets on the transfer belt; and a second determining step of determining, according to the distance calculated in the calculating step, what number of the paired toner marks are to be formed; wherein the toner mark pattern forming step forms the number of paired toner marks determined in the second determining step.

* * * * *